United States Patent [19]

Fawcett

[11] Patent Number: 4,881,063

[45] Date of Patent: Nov. 14, 1989

[54] BATTERY REMOVAL INDICATOR

[75] Inventor: Keith Fawcett, Limerick, Ireland

[73] Assignee: EI Company, Ltd., Shannon, Ireland

[21] Appl. No.: 302,913

[22] Filed: Jan. 30, 1989

[51] Int. Cl.[4] ..... G08B 21/00

[52] U.S. Cl. ..... 340/693; 116/303; 340/568; 340/628; 340/691

[58] Field of Search ..... 116/303, 5; 340/691, 340/693, 628, 568

[56] References Cited

U.S. PATENT DOCUMENTS 4,228,428 10/1980 Niedermeyer ..... 340/628

OTHER PUBLICATIONS

General Electric Home Sentry Smoke Alarm–Pub. No. #000861, 1976.

*Primary Examiner*—Glen R. Swann, III

*Attorney, Agent, or Firm*—Bachman & LaPointe

[57] ABSTRACT

The present invention relates to a battery removal indicator for battery operated units such as smoke detectors or fire alarms. The battery removal indicator is formed by a spring loaded member which is retained in a retracted position when a battery is present and which moves to a deployed position when the battery is absent. In its deployed position, the member prevents a cover of the unit from being engaged by a latch mechanism for securing the cover in a closed position. The unlatched cover acts as a first visual indication that the battery is not present. The member is also marked with warning indicia on one or more surfaces so as to provide a second visual indication that the battery is absent.

15 Claims, 2 Drawing Sheets

BATTERY REMOVAL INDICATOR

BACKGROUND OF THE INVENTION

The present invention relates to a battery removal indicator for battery operated units such as smoke detectors.

In many safety devices, a battery for supplying power is mounted within a cover. As a result, it is difficult to ascertain whether the battery is present or absent. Records have shown that two-thirds of smoke detectors which have been found not to respond in real life fire situations were without batteries.

Earlier, larger smoke detectors such as the GE Home Sentry Smoke Alarm Model 8201-101 were made with rotating warning flags which would deploy from under the cover if no battery was present. The flags were spring loaded and retained by a latch arrangement controlled by a lever retained under a 12 volt battery. This arrangement required a large amount of space, was expensive to produce, and was dependent upon uniform sized batteries. This system did not survive when the smoke detector industry changed over to smaller units powered by 9 volt batteries with high dimensional variability.

In other smoke detectors, gravity operated indicators were used to provide a visual indication that a battery was not present. U.S. Pat. No. 4,228,428 to Niedermeyer illustrates such a visual indicator. In the Niedermeyer patent, the visual indicator is formed by a cover of the smoke detector. The cover is hinged at one end and has a retaining clip secured to an inner surface at an opposite end. The clip has two arms each of which engage a respective side of a battery. When the battery is present in the detector, the cover is held in place by the engagement between the clip and the battery. When the battery is absent, the cover hangs down because there is nothing for the clip to engage. Problems arise with this type of visual indicator when the smoke detector is mounted incorrectly to a vertical surface. For example, if the smoke detector is inadvertently mounted to the vertical surface with the hinged end of the cover at the top, gravity will cause the cover to sit in a substantially closed position even though the battery is absent.

Accordingly, it is an object of the present invention to provide an improved battery removal indicator which functions irrespective of the orientation of the battery operated device.

It is a further object of the present invention to provide an improved battery removal indicator which is unaffected by battery dimensions.

It is yet a further object of the present invention to provide an improved battery removal indicator as above which provides two distinct visual signals.

It is still another object of the present invention to provide an improved battery removal indicator as above which is relatively inexpensive to produce.

These and other objects and advantages will become more apparent from the following description and drawings in which like reference numerals depict like elements.

SUMMARY OF THE INVENTION

As previously discussed, the present invention relates to an improved battery removal indicator for battery operated units such as smoke detectors or fire alarms. The battery removal indicator is formed by a spring loaded member which is retained in a retracted position when a battery is present and which moves to a deployed position when the battery is absent. In its deployed position, the member prevents a cover of the unit from being engaged by a latch mechanism for securing the cover in a closed position. Thereby providing a first visual indication that the battery is absent. Additionally, the member is marked with warning indicia on one or more surfaces so as to provide a second visual indication that the battery is absent.

While the present invention will be discussed in the context of a smoke detector, it should be recognized that it has utility in other types of battery operated devices.

DETAILED DESCRIPTION OF THE INVENTION

Figure 1:
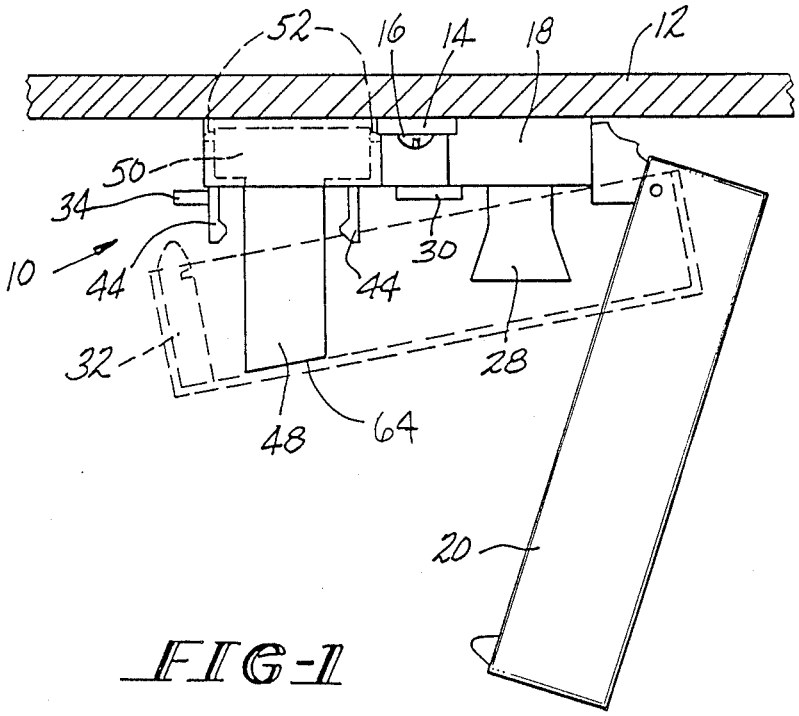
FIG. 1 is a side elevational view of a ceiling attached smoke detector with the battery removal indicator in its deployed position.

Referring now to the drawings, FIG. 1 illustrates a smoke detector 10 attached to a ceiling 12 by one or more mounting brackets 14 and fastener(s) 16 such as screw fastener(s). The smoke detector includes a base member 18 and a cover 20 hinged to the base member. Any suitable means known in the art such as one or more pin connections may be used to hinge the cover 20 to the base member 18.

Figure 3:
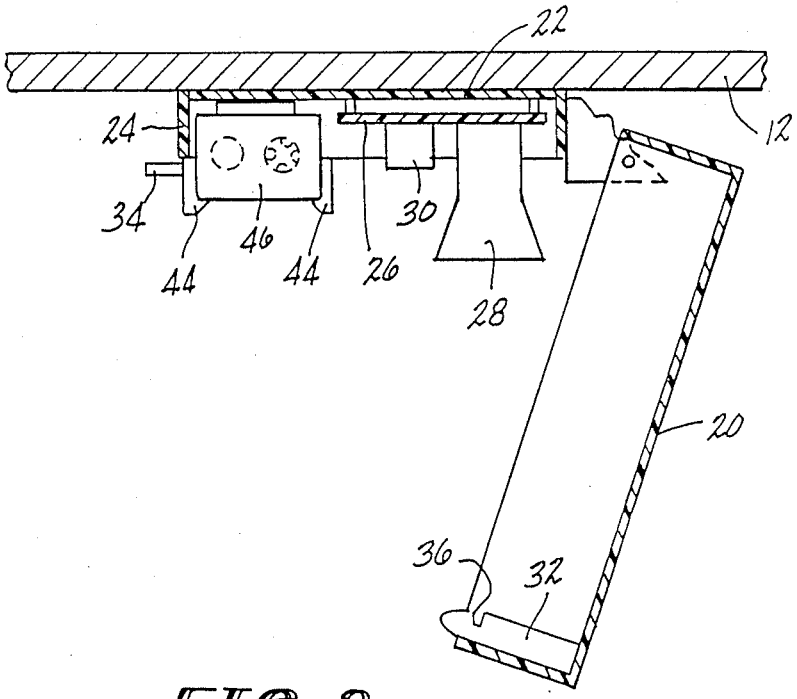
FIG. 3 is a cross-sectional view of a smoke detector with a battery in the battery compartment and the battery removal indicator in its retracted position.

As shown in FIG. 3, the base member 18 has a substantially planar base portion 22 and a raised lip portion 24. A circuit board 26 is mounted to the base portion 22 using any suitable means known in the art such as a screw and threaded post system. The circuit board 26 may hold various components of the detector such as a horn 28, a battery operated transducer not shown for operating the horn 28, electrical components forming part of the circuit and one or more sensors 30 activated by heat or smoke for energizing the transducer.

The cover 20 has a latch 32 for engaging a latching device 34 affixed to the raised lip portion 24 of the base. The latching device preferably has a groove 38 into which the latch 32 is inserted such that a slot 36 in the latch engages a portion 40 of the latching device 34.

The detector 10 further includes a battery compartment 42 generally within the base 18. Two upraised arms 44 having engaging portions 45 are situated in the battery compartment for holding a battery 46 in position. The battery 46 may be electrically connected to the circuit board and the other components of the detector by conventional electrical contacts and wires not shown.

Figure 2:
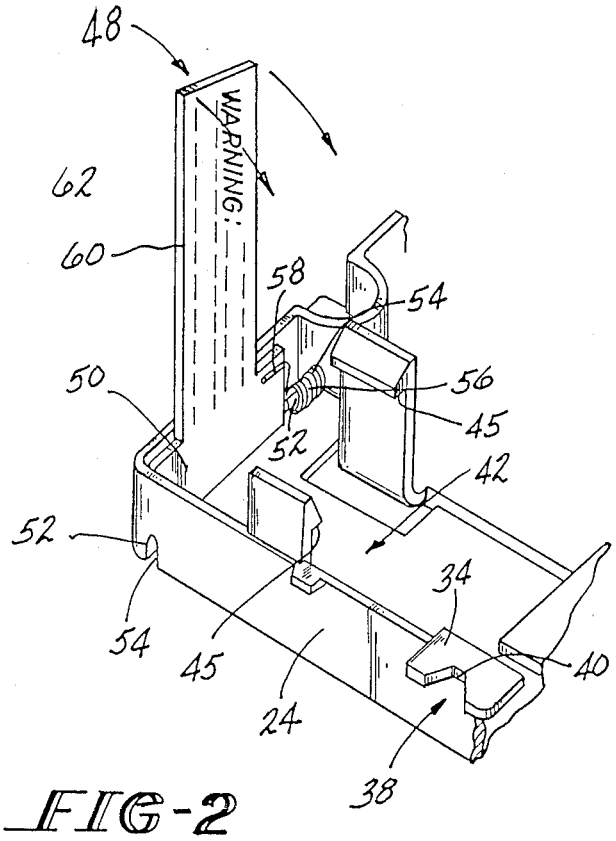
FIG. 2 is a perspective view of the battery compartment of the smoke detector with the battery removal indicator in its deployed position.

As shown in FIG. 2, the battery removal indicator 48 comprises a substantially planar member positioned adjacent an end of the battery compartment 42. The base portion 50 of the indicator 48 has two pivot pins 52, each along an edge of the indicator, which are received in slots 54 in the lip portion 24. The pivot pins 52 and slots 54 enable the indicator to rotate relative to the substantially planar base portion 22. Preferably, the indicator is hingedly mounted in the base to rotate about an axis substantially perpendicular to the pivot axis of the cover. Alternately, the indicator could be mounted to the base so as to rotate about an axis either parallel to or at an angle to the cover pivot axis.

Figure 4:
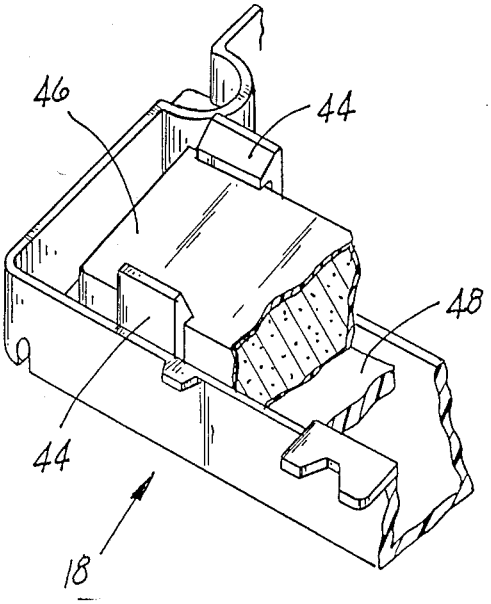
FIG. 4 is a perspective view of the battery compartment of the smoke detector with the battery removal indicator in its retracted position.

The indicator 48 preferaby has a longitudinally extending portion 60 which is sized to fit within the gap between the upraised arms. This enables the indicator to be placed in a retracted position as shown in FIG. 4 in which it is held in position by a battery 46. For reasons which will become more apparent hereinafter, the portion 60 may have an angled edge portion 64 for contacting the cover 20. The base portion 50 of the indicator 48 may have any desired size. If desired, the indicator 48 may have a substantially T-shaped configuration.

To insure that the indicator 48 is automatically deployed when the battery is absent, a spring member 56 is placed about one of the pins 52. The spring member 56 has an end portion 58 which overlaps a portion of the indicator such as base 50 and causes the indicator 48 to automatically move from a retracted position to its deployed position in the absence of a battery.

Suitable warning indicia 62 is preferably applied to one or more surfaces of the longitudinally extending portion 60. The warning indicia may be printed material on a label adhesively affixed to the surface(s). Alternatively, the warning indicia may be stamped into or embossed on the material forming the indicator 48. Still further, the indicator 48 may be formed from a material having a different color than that of the cover and/or base member.

While the indicator 48 may be formed from any suitable material, it is preferably formed from a plastic material. Similarly, the cover and base portion may be formed from any suitable materials including but not limited to plastic materials.

As shown in FIGS. 3 and 4, the battery 46 when positioned in the battery compartment holds the indicator 48 in its retracted position. When the battery is not present, spring member 56 causes the indicator to move to its deployed position. When the indicator 48 is in the deployed position, it acts as a strut. The edge portion 64 contacts the cover 20 if one tries to close it and due to the different axes of rotation of the cover and the indicator prevents latch 32 from engaging latching device 34. The edge portion 64 may be angled such that it engages fully with the cover 20 when the indicator 48 is deployed. Since the cover cannot assume its closed position because of the deployed indicator, the cover hangs down from its hinged end.

As can be seen from the foregoing discussion, the present invention provides two distinct visual signals that a battery is not present in the smoke detector. The first is the cover in its unlatched position. The second is the deployed indicator with its warning indicia.

While the invention has been described in connection with a ceiling mounted smoke detector, it should be apparent that the battery removal indicator will operate in exactly the same way in a wall-mounted or vertical surface mounted smoke detector.

While the invention has been described in the context of a smoke detector, it should be apparent that the battery removal indicator could be applied to many other pieces of equipment whose function would be impaired by batteries not being present. Thus, the present invention should not be construed as being limited to smoke detectors.

It is apparent that there has been provided in accordance with this invention a battery removal indicator which fully satisfies the objects, means, and advantages set further hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A battery removal indicator for use in a battery operated unit which includes a base member, at least one battery operated device attached to said base member, and a cover hingedly mounted to said base member for rotation about a first axis, said indicator comprising spring loaded means for preventing said cover from closing and for providing a separate visual indication that a battery is not present in said unit.

2. A battery removal indicator according to claim 1 wherein said spring loaded means rotates about a second axis.

3. A battery removal indicator according to claim 1 wherein said spring loaded means comprises a substantially planar indicator member hingedly mounted to said base member.

4. A battery removal indicator according to claim 3 wherein:

said base member has a raised portion;

said raised portion has two spaced apart slots; and said indicator member has two pins located on opposed edges for engaging said spaced apart slots.

5. A battery removal indicator according to claim 4 which further comprises a spring member for moving said indicator member between a retracted position and a deployed position, said spring member surrounding one of said pins and having an end portion overlapping a surface of said indicator member.

6. A battery removal indicator according to claim 3 wherein said indicator member has warning indicia on at least one surface.

7. A battery removal indicator according to claim 1 wherein:

said cover has a latch;

said base member has a latch engaging device; and said spring loaded means prevents said latch from contacting said latch engaging device.

8. A battery removal indicator according to claim 1 wherein said battery operated unit comprises a smoke detector.

9. A battery removal indicator according to claim 1 wherein:

said base member has two spaced arms for holding a battery; and said spring loaded means has a portion sized to fit between said arms so that when a battery is properly positioned between said arms, said battery holds said spring loaded means in a retracted position.

10. A battery operated smoke detector having an indicator for displaying a visual warning that a battery is not present, said smoke detector comprising:

a base member;

a battery operated alarm device mounted to said base member;

a cover pivotably mounted to said base member for rotation about a first axis;

said cover having a latch for contacting an engaging device affixed to said base member; and said indicator being formed by a pivotable member rotatable about a second axis substantially transverse to said first axis, said pivotable member in its deployed position preventing said latch from contacting said engaging device.

11. A smoke detector according to claim 10 wherein said pivotable member is spring loaded so that it automatically moves from a retracted position to a deployed position when said battery is not present.

12. A smoke detector according to claim 10 which further comprises:

means for engaging a battery for powering said detector and for holding said battery in a desired position relative to said base portion; and said indicator being held in a retracted position by said battery when said battery is positioned in said engaging and holding means.

13. A smoke detector according to claim 10 wherein the alarm device includes means for issuing an audible alarm.

14. A smoke detector according to claim 10 wherein:

said pivotable member has warning indicia on at least one surface and acts as a first visual indication that the battery is not present; and said cover acts as a second distinct visual indication that the battery is not present.

15. A smoke detector according to claim 10 wherein said pivotable member is substantially T-shaped and has on angled edge portion for contacting said cover.

* * * * *